US007905207B2

(12) United States Patent
Lee et al.

(10) Patent No.: US 7,905,207 B2
(45) Date of Patent: Mar. 15, 2011

(54) VARIABLE VALVE LIFT APPARATUS

(75) Inventors: Eun Ho Lee, Hwaseong (KR); Young Hong Kwak, Suwon (KR); Kiyoung Kwon, Seoul (KR); Jin Kook Kong, Suwon (KR); Soo Hyung Woo, Yongin (KR); Kyoung Joon Chang, Seongnam (KR)

(73) Assignee: Hyundai Motor Company, Seoul (KR)

( * ) Notice: Subject to any disclaimer, the term of this patent is extended or adjusted under 35 U.S.C. 154(b) by 302 days.

(21) Appl. No.: 12/274,886

(22) Filed: Nov. 20, 2008

(65) Prior Publication Data

US 2009/0293825 A1 Dec. 3, 2009

(30) Foreign Application Priority Data

May 29, 2008 (KR) ..... 10-2008-0050296

(51) Int. Cl.
*F01L 1/34* (2006.01)

(52) U.S. Cl. ..... 123/90.16; 123/90.39; 123/90.44; 74/569

(58) Field of Classification Search ..... 123/90.15, 123/90.16, 90.17, 90.18, 90.39, 90.44; 74/559, 74/567, 569
See application file for complete search history.

(56) References Cited

U.S. PATENT DOCUMENTS 7,600,496 B2 * 10/2009 Nakamura et al. ..... 123/90.16

* cited by examiner

*Primary Examiner* — Ching Chang
(74) *Attorney, Agent, or Firm* — Morgan, Lewis & Bockius LLP

(57) ABSTRACT

A variable valve lift apparatus may include a camshaft having an input cam, a rocker arm shaft disposed in parallel with the camshaft with a distance therebetween, a shaft carrier with a camshaft and a rocker arm shaft, a rocker arm that is mounted on the rocker arm shaft with a first roller contacting the input cam, a first link connected to the rocker arm, an amplification lever with a middle portion thereof connected to the first link and the shaft carrier, a second link connected to the amplification lever, an output cam mounted on the camshaft, one side of the output cam connected to the second link, and a profile portion formed at an exterior circumference thereof, a variable driveshaft rotating the shaft carrier by a predetermined angle, and a valve moved by the profile portion with rotation of the output cam.

16 Claims, 7 Drawing Sheets

VARIABLE VALVE LIFT APPARATUS

CROSS-REFERENCE TO RELATED APPLICATION

The present application claims priority to Korean Patent Application No. 10-2008-0050296, filed on May 29, 2008, the entire contents of which are incorporated herein for all purposes by this reference.

BACKGROUND OF THE INVENTION

1. Field of the Invention

The present invention relates to an engine of a vehicle, and more particularly to a variable valve lift apparatus that continuously changes a lift amount of a valve.

2. Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open.

In addition, exhaust valves are operated by the camshaft, and a combustion gas is exhausted from the combustion chamber while the exhaust valves are open.

An optimal operation of the intake valves and the exhaust valves depends on a rotation speed of the engine. That is, an optimal lift or optimal opening/closing timing of the valves depends on the rotation speed of the engine.

For example, research has been undertaken for a variable valve lift (VVL) apparatus that enables different lifts depending on engine speed, and for a variable valve timing (VVT) apparatus that opens/closes the valves with different timing depending on the engine speed.

However, a rotating direction of a rocker arm and an amplification lever is different in the valve lift apparatus such that a profile characteristic of an output cam for operating a valve is poor.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable valve lift apparatus having advantages of minimizing friction and output loss and improving controllability and assemblability and to provide a variable valve lift apparatus having advantages of advancing the operating timing as the lift amount of the valve is reduced, and reducing fuel consumption.

In an aspect of the present invention, a variable valve lift apparatus, may include a camshaft including an input cam co-axially mounted thereon, a rocker arm shaft disposed in parallel with the camshaft with a predetermined distance therebetween, a shaft carrier, wherein the camshaft is rotatably coupled to first side of the shaft carrier and the rocker arm shaft is pivotally coupled to a second side thereof, a rocker arm that is pivotally coupled to the rocker arm shaft and includes a first roller disposed at one end portion of the rocker arm and contacting the input cam, a first link pivotally coupled to the other end portion of the rocker arm, an amplification lever pivotally coupled to one end portion of the first link, wherein one end portion of the amplification lever is coupled to the shaft carrier, a second link, one end portion of which is pivotally coupled to the other end of the amplification lever, an output cam, a first end portion of which is rotatably coupled to the camshaft and a second end portion of which is pivotally coupled to the other end portion of the second link, wherein a profile portion is formed at one side of an exterior circumference of the output cam, a variable driveshaft coupled to the rocker arm shaft and rotating the shaft carrier by a predetermined angle, and/or a valve that is moved by the profile portion of the output cam according to rotation of the output cam.

The profile portion may be formed at the output cam between the second end portion and a contact point that the output cam and a second roller of a swing arm contact each other.

The variable valve lift may further include an arm of which one side thereof is connected to the variable driveshaft and the other side thereof is connected to the rocker arm shaft.

The predetermined angle of the variable driveshaft may be regulated by a control member.

The camshaft and the rocker arm shaft may penetrate the shaft carrier to be mounted thereto.

The variable driveshaft may rotate the shaft carrier with respect to a rotation center of the cam shaft by the predetermined angle. The predetermined angle of the variable driveshaft may be regulated by a control member. An arm may be connected to the variable driveshaft and the other side thereof may be connected to the rocker arm shaft.

The cam shaft may penetrate substantially the middle portion of the output cam.

The variable valve lift apparatus may further include a swing arm that comes in contact with an outside surface of the profile portion of the output cam, wherein one side of the swing arm is pivotally supported by a hydraulic pressure valve gap adjustment member and the other side of the swing arm operates the valve.

The first end portion of the output cam may have a circular exterior circumference except the profile portion, which is substantially the same as the base circle of the input cam.

The first end portion of the output cam may have a circular exterior circumference except the profile portion, the circular exterior circumference having the same diameter as the input cam.

The variable valve lift apparatus may further include a return spring that is mounted on the rocker arm shaft to bias the first roller of the rocker arm to the input cam.

The rocker arm, the first link, the amplification lever, the second link, and the profile portion may be sequentially disposed in a clockwise direction or in an anti-clockwise direction.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

A variable valve apparatus is explained in the following according to various exemplary embodiments of the present invention, while referring to the accompanying drawings.

Figure 1:
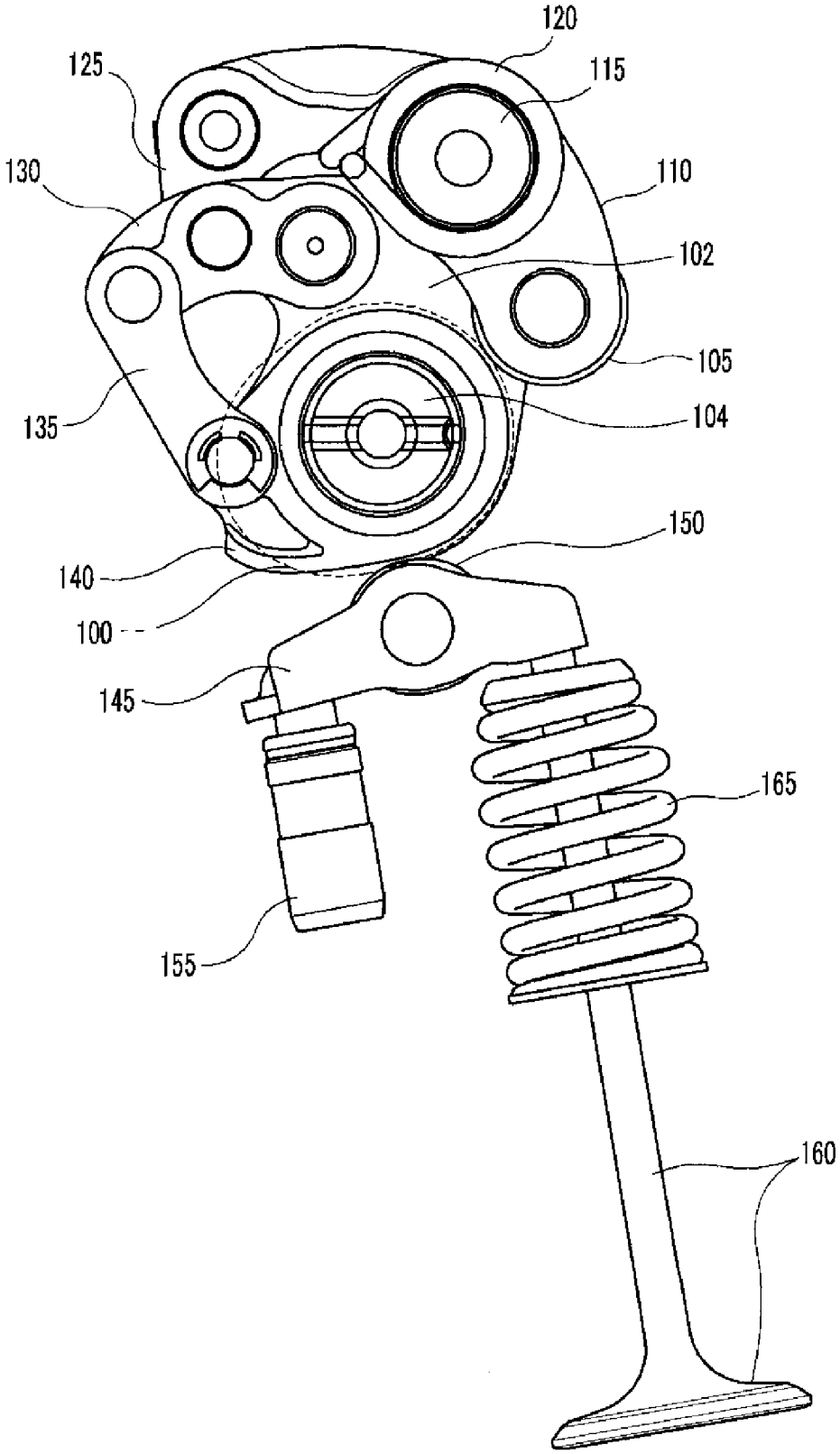
FIG. 1 is a side view of a variable valve lift apparatus according to an exemplary embodiment of the present invention.

FIG. 1 is a side view of a variable valve lift apparatus according to an exemplary embodiment of the present invention.

Referring to FIG. 1, the variable valve lift apparatus includes an input cam 100, a shaft carrier 102, a camshaft 104, a first roller 105, a rocker arm 110, a rocker arm shaft 115, a return spring 120, a first link 125, an amplification lever 130, a second link 135, an output cam 140, a swing arm 145, a second roller 150, a valve gap adjustment member 155, a valve 160, and a valve spring 165.

First, the torque of the camshaft 104 is transferred to the valve 160 through the input cam 100, the first roller 105, the rocker arm 110, the first link 125, the amplification lever 130, the second link 135, the output cam 140, the second roller 150, and the swing arm 145, and the valve 160 is lifted in a length direction as a predetermined lift.

The shaft carrier 102 is mounted on the camshaft 104 and the rocker arm shaft 115 is disposed in the shaft carrier 102. The camshaft 104 and the rocker arm shaft 115 are disposed in parallel with each other, and the rocker arm 110 is rotatably mounted on the rocker arm shaft 115.

The first roller 105 is disposed in one end portion of the rocker arm 110 and the first link 125 is connected to the other end portion of the rocker arm 110. The rocker arm 110 is biased in a clockwise direction by the return spring 120 that is mounted on a middle portion of the rocker arm shaft 115. Accordingly, the first roller 105 contacts the input cam 100 by elastic restoring force of the return spring 120.

One end of the amplification lever 130 is pivotally coupled to the shaft carrier 102 and the other end of the amplification lever 130 is rotatably connected to one end of the second link 135. The middle portion of the amplification lever 130 is connected to the one end portion of the first link 125 by a hinge, wherein the other end portion of the first link 125 is rotatably coupled to the other end portion of the rocker arm 110.

One end portion of the second link 135 is pivotally connected to the amplification lever 130 and the other portion of the second link 135 is pivotally connected to one end portion of the output cam 140 by a hinge. The output cam 140 is mounted on the camshaft 104, wherein the camshaft 104 penetrates substantially the middle portion of the output cam 140.

Figure 2:
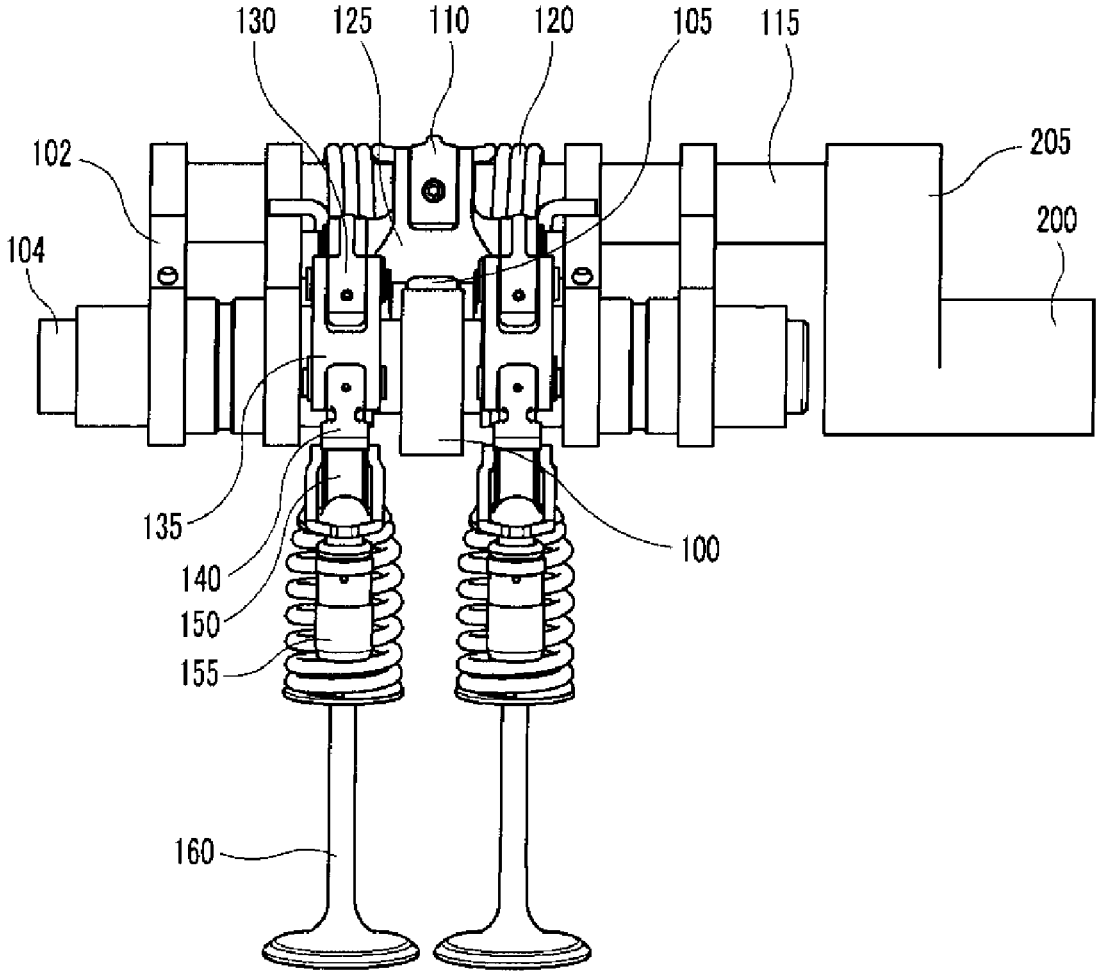
FIG. 2 is a front view of a variable valve lift apparatus according to an exemplary embodiment of the present invention.
Figure 3:
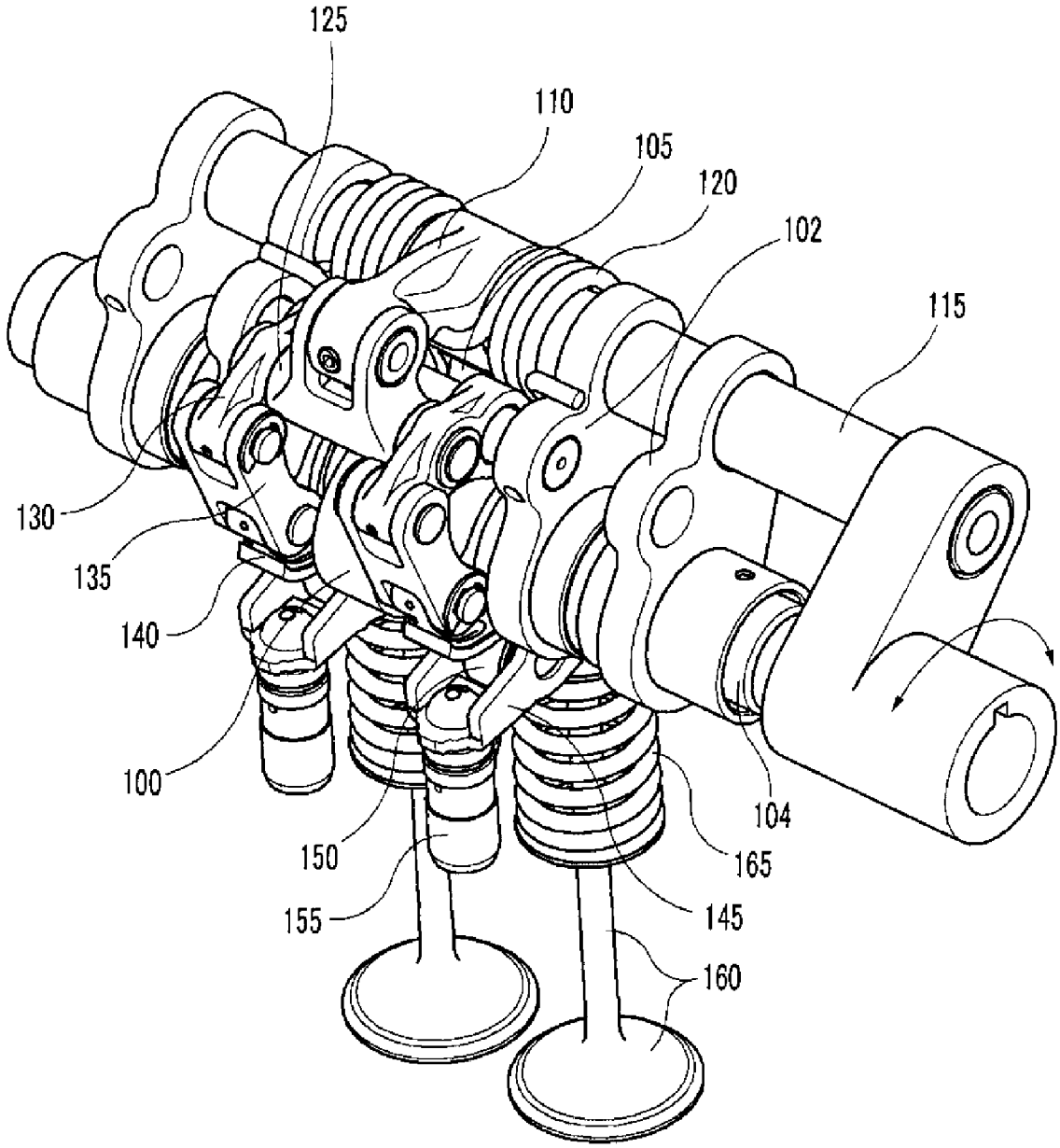
FIG. 3 is a perspective view of a variable valve lift apparatus according to an exemplary embodiment of the present invention.

Referring to FIG. 2 and FIG. 3, the structure in which the lift characteristic of the valve 160 is varied by a variable valve lift apparatus is explained in the following.

FIG. 2 is a front view of a variable valve lift apparatus according to an exemplary embodiment of the present invention, and FIG. 3 is a perspective view of a variable valve lift apparatus according to an exemplary embodiment of the present invention.

Referring to FIG. 2 and FIG. 3, the input cam 100 is disposed substantially in the middle portion of the camshaft 104 and the rocker arm 110 is disposed in the rocker arm shaft 115 corresponding to the input cam 100.

The first link 125, the amplification lever 130, the second link 135, the output cam 140, the second roller 150, the swing arm 145, and the valve 160 are disposed at both sides of the rocker arm shaft 115. Also, the shaft carriers 102 are respectively disposed at both sides of the rocker arm 110.

As shown, the camshaft 104 and the rocker arm shaft 115 are disposed in parallel with each other, and the camshaft 104 and the rocker arm shaft 115 penetrate the shaft carrier 102 to be assembled. Also, the camshaft 104 that is mounted on the shaft carrier 102 rotates. The camshaft 104 and the rocker arm shaft 115 rotate independently.

As shown in FIG. 2 and FIG. 3, in various embodiments of the present invention, a variable driveshaft 200 may be disposed at the same axis as that of the camshaft 104. The variable driveshaft 200 is disposed in a length direction of the camshaft 104 and an arm 205 is formed at an end portion of the variable driveshaft 200. The arm 205 is extended from an exterior circumference of the variable driveshaft 200 and is connected to the rocker arm shaft 115 at the other end portion thereof.

One end portion of the rocker arm shaft 115 is inserted into the other end portion of the arm 205 and the rocker arm shaft 115 that is engaged with the arm 205 can rotate with respect to a rotation axis of the variable driveshaft 200.

When the variable driveshaft 200 rotates in a clockwise direction by a control portion and a driving portion, the rocker arm shaft 115 and the shaft carrier 102 rotate in a clockwise direction based on the camshaft 104.

Further, referring to FIG. 1, when the shaft carrier 102 rotates in an anti-clockwise direction by the variable driveshaft 200, the rocker arm 110 and the first roller 105 rotate in an anti-clockwise direction. In addition, the output cam 140 rotates in an anti-clockwise direction on the camshaft 104 as explained later in detail.

In a state in which the camshaft 104 rotates in an anti-clockwise direction, when the shaft carrier 102 rotates in an anti-clockwise direction, the timing at which the rocker arm 110 moves is retarded. Also, in a state in which the camshaft 104 rotates in a clockwise direction, when the shaft carrier 102 rotates in a clockwise direction, the timing at which the rocker arm 110 moves is advanced.

In a state in which the camshaft 104 rotates in a clockwise direction, when the shaft carrier 102 rotates in an anti-clockwise direction, the timing at which the rocker arm 110 moves is advanced. Also, in a state in which the camshaft 104 rotates in an anti-clockwise direction, when the shaft carrier 102 rotates in a clockwise direction, the timing at which the rocker arm 110 moves is retarded.

The camshaft 104 can rotate in a clockwise direction or in an anti-clockwise direction according to design specifications in various embodiments. Also, the valve gap adjustment member 155 actively supports one end of the swing arm 145 by hydraulic pressure to secure the movement of the valve 160.

Referring to FIG. 1, the first roller 105, the rocker arm 110, the first link 125, the amplification lever 130, the second link 135, and the output cam 140 are disposed in an anti-clockwise direction.

Figure 4:
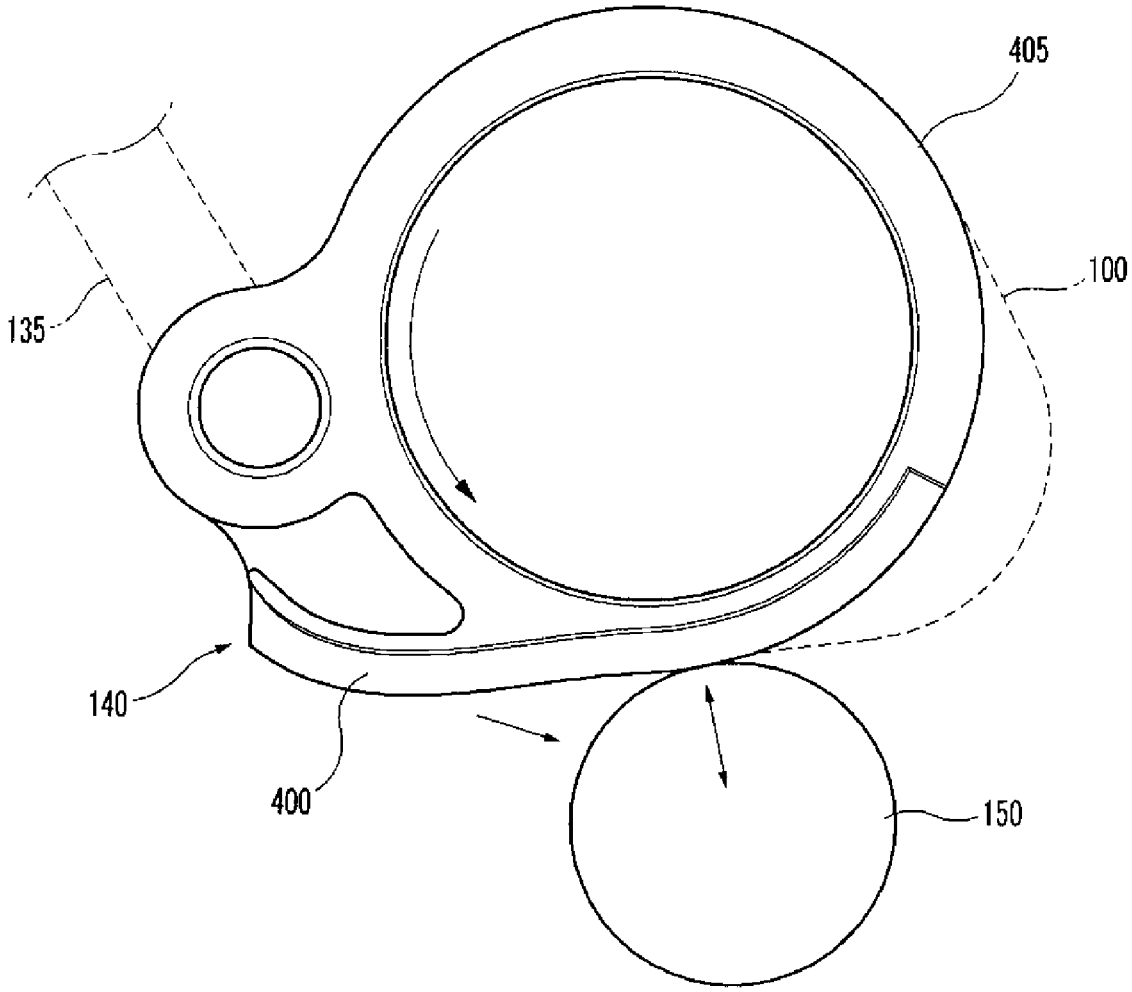
FIG. 4 is a partial detailed view of a variable valve lift apparatus according to an exemplary embodiment of the present invention.

FIG. 4 is a partial detailed view of a variable valve lift apparatus according to an exemplary embodiment of the present invention.

Referring to FIG. 4, the arrangement relationships of the second link 135, the output cam 140, and the second roller 150 are explained hereinafter.

One side of the output cam 140 is connected to the second link 135, and the output cam 140 through which the camshaft 104 is inserted has a ring shape. Accordingly, the interior circumference of the output cam 140 slides with the exterior circumference of the camshaft 104.

A connection portion (left side) that is connected to the second link 135 is formed at one side of the exterior circumference of the output cam 140, and the other side of the exterior circumference of the output cam 140 contacts the second roller 150. Also, the profile portion 400 protrudes at an exterior circumference of the output cam 140 between the connection portion and the second roller 150.

The profile portion 400 substantially contacts the second roller 150 and moves the swing arm 145 and the valve 160, and the thickness of the profile portion 400 gets wider from the second roller 150 to the connection portion.

The overall outline of the exterior circumference of the output cam 140 except the profile portion 400 and the connection portion has a circular shape corresponding to the base circle 405 of the input cam 100.

One side of the exterior circumference of the output cam 140 has a path that is the same as that of the base circle of the input cam, so it is possible for the second roller 150 to be directly operated by the input cam.

That is, in FIG. 2, in a state in which a position of the camshaft 104 is not changed, the swing arm 145 and the valve 160 are positioned corresponding the input cam 100, and then the second roller 150 and the swing arm 145 are directly operated by the input cam 100.

Figure 5:
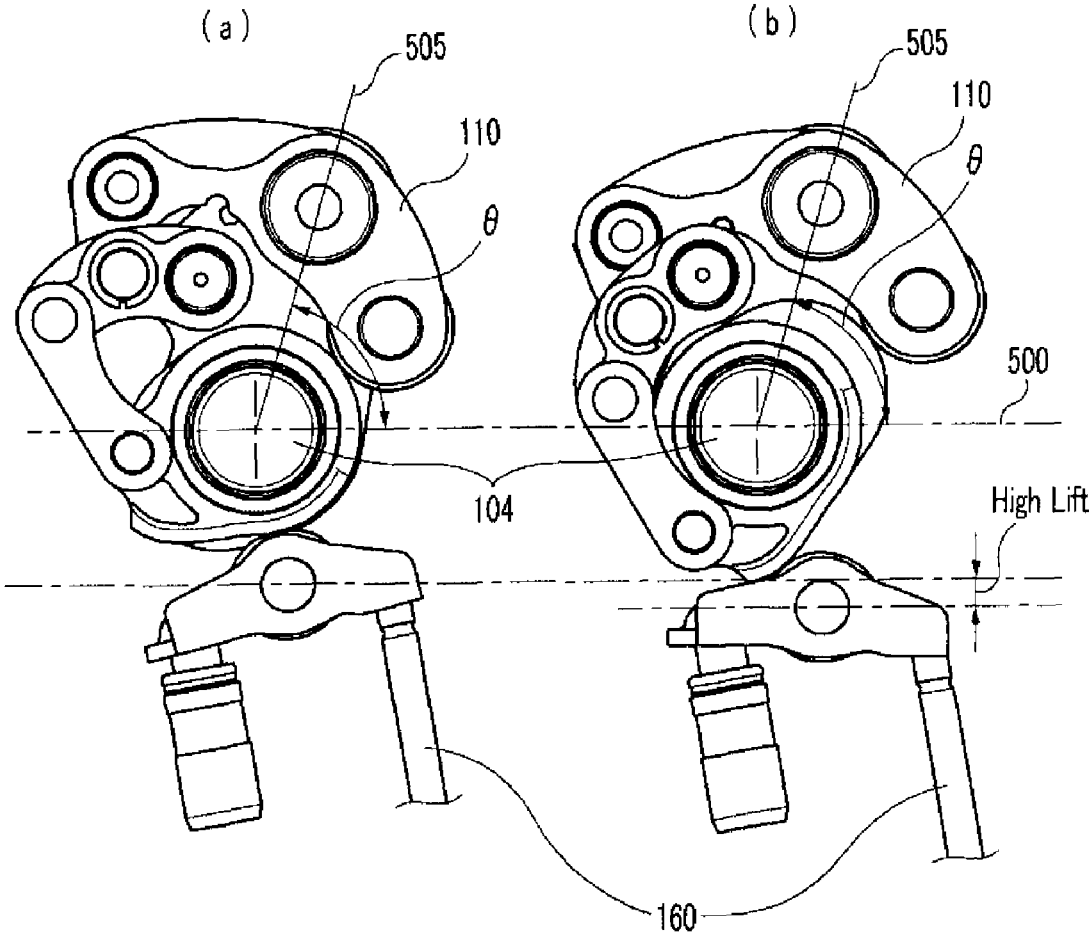
FIG. 5 is a side view showing a high lift condition of a variable valve lift apparatus according to an exemplary embodiment of the present invention.

FIG. 5 is a side view showing a high lift condition of a variable valve lift apparatus according to an exemplary embodiment of the present invention.

The valve 160 is not lifted by the output cam 140 in (a) of FIG. 5, and the valve 10 is lifted by the output cam 140 in (b) of FIG. 5.

As shown, a horizontal line 500 that passes through the center of the camshaft 104 has a cross angle θ with a slanted line 505 that passes from the center of the camshaft 104 to the center of the rocker arm shaft 115 ($0° < \theta < 90°$).

When the cross angle that the horizontal line 500 and the slanted line 505 form is θ in various embodiments, the valve 160 is lifted high.

Figure 6:
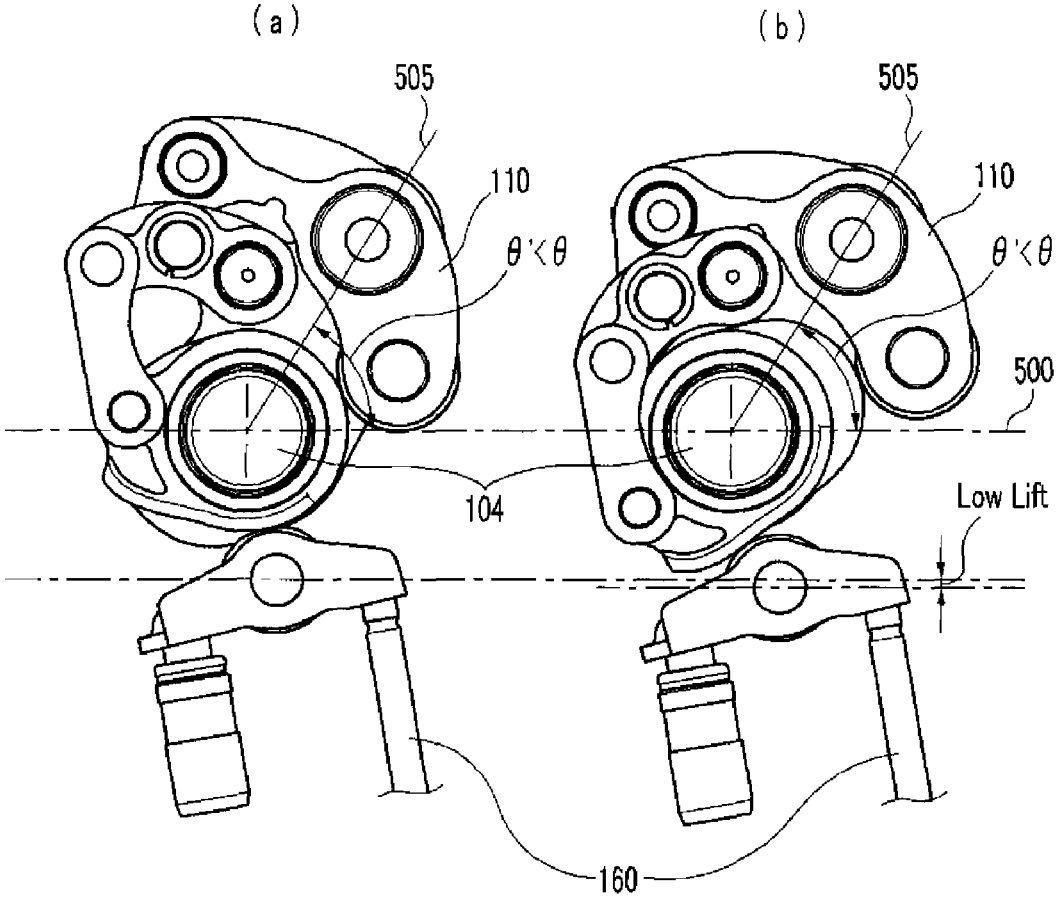
FIG. 6 is a side view showing a low lift condition of a variable valve lift apparatus according to an exemplary embodiment of the present invention.

FIG. 6 is a side view showing a low lift condition of a variable valve lift apparatus according to an exemplary embodiment of the present invention.

The valve 160 is not lifted in (a) of FIG. 6, and the valve 160 is lifted by the output cam 140 in (b) of FIG. 6.

As shown, the cross angle of a horizontal line 500 that passes through the camshaft 104 and a slanted line 505 that passes from the center of the camshaft 104 to the center of the rocker arm shaft 115 is $\theta'(0<\theta'<\theta<90)$.

When the cross angle of the horizontal line 500 and the slanted line 505 is θ', the valve 160 is lifted low in the illustrated exemplary embodiment.

Figure 7:
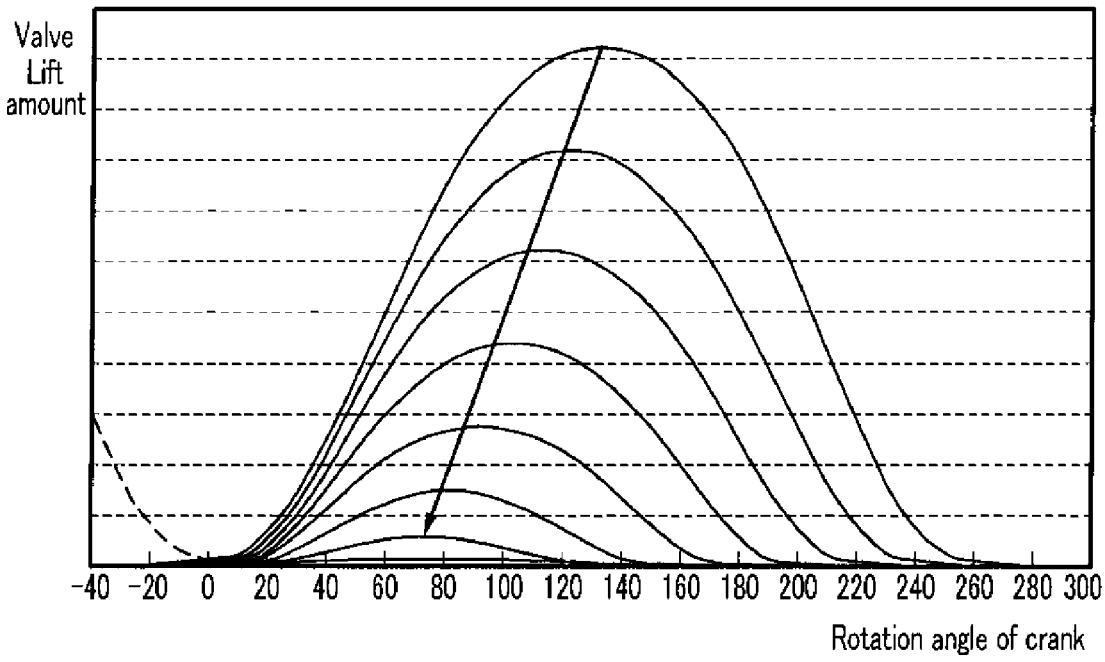
FIG. 7 is a graph showing a lift amount of a variable valve according to an exemplary embodiment of the present invention.

FIG. 7 is a graph showing a lift amount of a variable valve 160 according to an exemplary embodiment of the present invention.

As shown, the horizontal axis shows a rotation angle of a crankshaft, and the vertical axis shows a lift amount of the valve.

As shown in FIG. 7, a variable valve lift as well as variable valve timing can be achieved in the variable valve lift apparatus according to various embodiments of the present invention.

In addition, referring to FIGS. 5 and 6, the opening timing of the valve 160 is advanced as the lift amount of the valve is reduced and the camshaft 104 rotates in a clockwise direction in the illustrated exemplary embodiment, and the opening timing of the valve 160 is retarded as the lift amount of the valve is increased and the camshaft 104 rotates in an anti-clockwise direction.

Further, according to the design specifications of the above constituent elements, the opening timing of the valve 160 is retarded as the lift amount of the valve is reduced and the camshaft 104 rotates in an anti-clockwise direction and the opening timing of the valve 160 is advanced as the lift amount of the valve is increased and the camshaft 104 rotates in a clockwise direction.

At the same time, according to various embodiments of the present invention, the mounting height of the variable valve lift apparatus is the same as that of the center of the camshaft such that assemblability and compatibility thereof can be improved.

For convenience in explanation and accurate definition in the appended claims, the terms "interior" and "exterior" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift apparatus, comprising:

a camshaft including an input cam co-axially mounted thereon;

a rocker arm shaft disposed in parallel with the camshaft with a predetermined distance therebetween;

a shaft carrier, wherein the camshaft is rotatably coupled to a first side of the shaft carrier and the rocker arm shaft is pivotally coupled to a second side thereof;

a rocker arm that is pivotally coupled to the rocker arm shaft and includes a first roller disposed at one end portion of the rocker arm and contacting the input cam;

a first link pivotally coupled to the other end portion of the rocker arm;

an amplification lever pivotally coupled to one end portion of the first link, wherein one end portion of the amplification lever is coupled to the shaft carrier;

a second link, one end portion of which is pivotally coupled to the other end of the amplification lever;

an output cam, a first end portion of which is rotatably coupled to the camshaft and a second end portion of which is pivotally coupled to the other end portion of the second link, wherein a profile portion is formed at one side of an exterior circumference of the output cam;

a variable driveshaft coupled to the rocker arm shaft and rotating the shaft carrier by a predetermined angle; and a valve that is moved by the profile portion of the output cam according to rotation of the output cam.

2. The variable valve lift apparatus of claim 1, wherein the profile portion is formed at the output cam between the second end portion and a contact point that the output cam and a second roller of a swing arm contact each other.

3. The variable valve lift apparatus of claim 1, further comprising an arm of which one side thereof is connected to the variable driveshaft and the other side thereof is connected to the rocker arm shaft.

4. The variable valve lift apparatus of claim 1, wherein the predetermined angle of the variable driveshaft is regulated by a control member.

5. The variable valve lift apparatus of claim 1, wherein the camshaft and the rocker arm shaft penetrate the shaft carrier to be mounted thereto.

6. The variable valve lift apparatus of claim 1, wherein the variable driveshaft rotates the shaft carrier with respect to a rotation center of the cam shaft by the predetermined angle.

7. The variable valve lift apparatus of claim 6, wherein the predetermined angle of the variable driveshaft is regulated by a control member.

8. The variable valve lift apparatus of claim 6, further comprising an arm of which one side thereof is connected to the variable driveshaft and the other side thereof is connected to the rocker arm shaft.

9. The variable valve lift apparatus of claim 1, wherein the cam shaft penetrates substantially the middle portion of the output cam.

10. The variable valve lift apparatus of claim 1, further comprising a swing arm that comes in contact with an outside surface of the profile portion of the output cam, wherein one side of the swing arm is pivotally supported by a hydraulic pressure valve gap adjustment member and the other side of the swing arm operates the valve.

11. The variable valve lift apparatus of claim 1, wherein the first end portion of the output cam have a circular exterior circumference except the profile portion, which is substantially the same as the base circle of the input cam.

12. The variable valve lift apparatus of claim 1, wherein the first end portion of the output cam have a circular exterior circumference except the profile portion, the circular exterior circumference having the same diameter as the input cam.

13. The variable valve lift apparatus of claim 1, further comprising a return spring that is mounted on the rocker arm shaft to bias the first roller of the rocker arm to the input cam.

14. The variable valve lift apparatus of claim 1, wherein the rocker arm, the first link, the amplification lever, the second link, and the profile portion are sequentially disposed in a clockwise direction or in an anti-clockwise direction.

15. An engine comprising the variable valve lift apparatus of claim 1.

16. A passenger vehicle comprising the engine of claim 15.

* * * * *